United States Patent [19]

Marks et al.

[11] 4,192,568

[45] Mar. 11, 1980

[54] CONNECTOR ASSEMBLY AND IMPROVED CONNECTOR PLUG

[75] Inventors: Richard L. Marks, Mechanicsburg; Charles H. Weidler, Lancaster, both of Pa.

[73] Assignee: AMP Incorporated, Harrisburg, Pa.

[21] Appl. No.: 905,503

[22] Filed: May 12, 1978

[51] Int. Cl.[2] ..... H01R 13/54

[52] U.S. Cl. ..... 339/91 R

[58] Field of Search ..... 339/91 R, 97 R, 97 P, 339/98, 99 R, 128, 176 M, 176 MP, 176 R

[56] References Cited

U.S. PATENT DOCUMENTS

| | | | |
|---|---|---|---|
| 3,569,909 | 3/1971 | Garver | 339/91 R |
| 3,605,070 | 9/1971 | Krafthefer | 339/91 R |
| 3,706,954 | 12/1972 | Krafthefer | 339/91 R X |
| 3,860,318 | 1/1975 | Reavis | 339/99 R |
| 4,010,998 | 3/1977 | Tolnar | 339/91 R |

*Primary Examiner*—Joseph H. McGlynn

*Assistant Examiner*—John S. Brown

*Attorney, Agent, or Firm*—Frederick W. Raring

[57] ABSTRACT

Multi-contact electric connector assembly comprises a connector plug and a connector receptacle. The connector receptacle has a hood extending forwardly from its mating face which surrounds the plug when the parts are mated. A latching means is provided on the receptacle in the form of flexible latch arms extending from the housing of the receptacle and projecting through an opening in the hood adjacent to the housing. The latch arms have a shoulder which engages complementary shoulders adjacent to the mating face of the connector plug. The plug is also provided with camming ramps adjacent to its mating face which cooperate with the latch arm on a terminal pin header when the connector plug is mated with the pin header. The camming ramps deflect the latch arm of the pin header away from the shoulders of the plug when the plug is mated with and disengaged from the pin header.

4 Claims, 6 Drawing Figures

Fig. 3
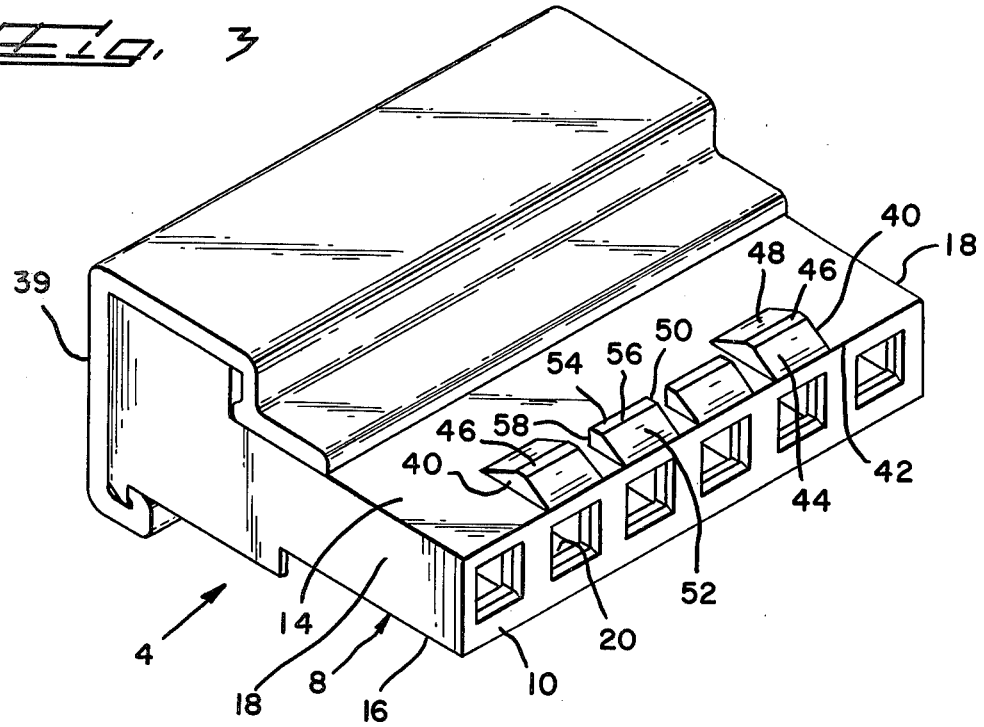
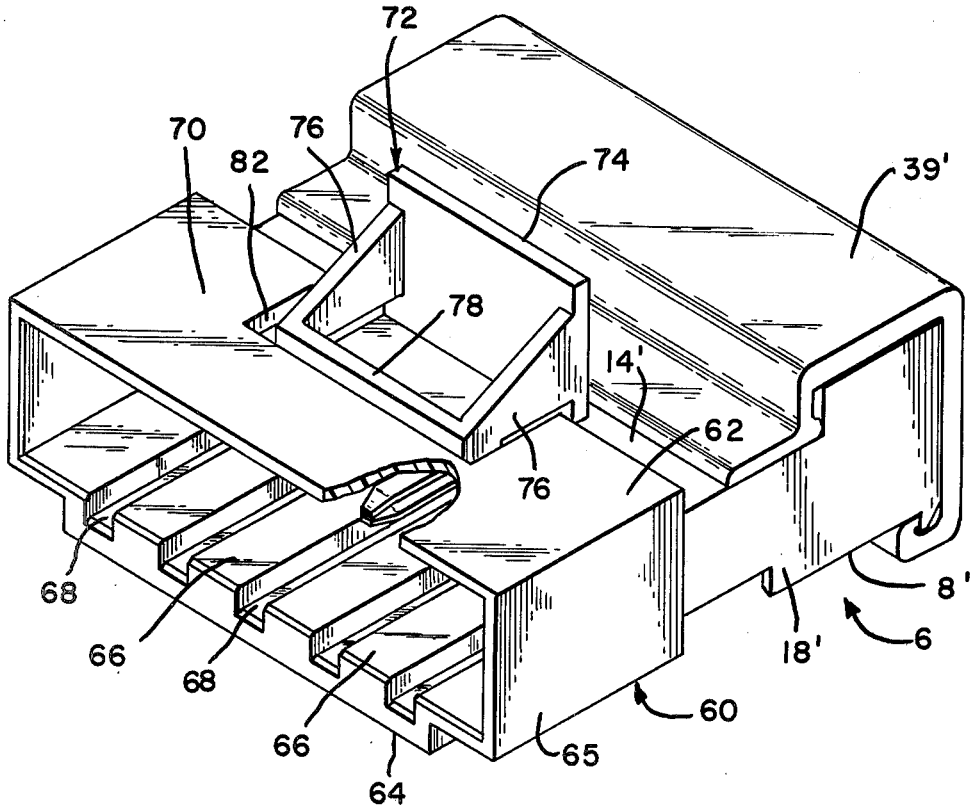
Fig. 4

CONNECTOR ASSEMBLY AND IMPROVED CONNECTOR PLUG

BACKGROUND OF THE INVENTION

This invention relates to electrical connector assemblies of the type comprising a connector plug and a complementary connector receptacle. The invention is particularly directed to the achievement of an improved connector assembly which permits usage of the plug for at least two types of disengageable electrical connections.

Manufacturers of electrical and electronic equipment frequently require several different types of multi-contact electrical connectors in order to satisfy different types of connecting requirements. For example, a manufacturer of television sets may require multi-contact electrical connectors which must be mounted in a panel such as a chassis panel, connectors which can be mated with contact posts extending from a circuit board, and connectors which can be mated and latched to a complementary connector so that the two connectors of the assembly cannot be readily disengaged from each other. These diverse requirements frequently lead to the necessity of using many different types of connectors in the manufacturing process with the attendant inconveniences and expenses involved in obtaining, and maintaining an inventory of, the different types of connectors required. It is always desirable, therefore, to use electrical connectors which are capable of carrying out several connecting functions; in other words, connectors which are capable of serving more than one purpose and satisfying more than one requirement in the manufacturing process.

Application Ser. No. 859,067, now U.S. Pat. No. 4,159,158 discloses and claims an improved multi-contact electrical connector which is particularly intended to be mated with contact terminal posts which extend from a circuit board and application Ser. No. 879,575 discloses and claims a back cover having optionally usable panel mounting means for the connector disclosed in the former application. The instant invention is directed to the achievement of a connector of the general class disclosed in application Ser. No. 859,067 now U.S. Pat. No. 4,159,158 which is capable of multiple uses including mating with terminal posts and mating with a complementary connector.

In accordance with the principles of the present invention, a connector assembly comprises a connector receptacle and a connector plug, the receptacle having a hood extending from its mating face which surrounds a portion of the connector plug when the two parts are mated. The receptacle and the plug are disengageably latched to each other by a latching means which is integral with the housing portion of the receptacle and which has latch arm means which extends through an opening in the hood. This latch arm means engages shoulder means on the connector plug when the parts are mated and prevents their being unmated without a deliberate flexing or other manipulation of the latch arm means. The plug is provided with camming ramps adjacent to its mating face which cooperate with the latch arm means of a terminal header when the connector plug is mated with the posts of the header. The camming ramps serve to prevent unintentional removal or disengagement of the plug from the terminal posts and, in addition, they serve to prevent the latching shoulders of the plug from engaging the latching arm of the header.

It is accordingly an object of the invention to provide an improved electrical connector assembly. A further object is to provide an improved connector plug capable of multiple uses. A further object is to provide a plug which can be mated with either a complementary receptacle or with terminal posts extending from a post header mounted on a circuit board. A further object is to achieve a reduction in the number of types of electrical connectors required to satisfy several different electrical connection requirements in a typical manufacturing process.

These and other objects of the invention are achieved in a preferred embodiment thereof which is briefly described in the foregoing abstract, which is described in detail below, and which is shown in the accompanying drawing in which:

FIG. 3 is a perspective view of a connector plug in accordance with the invention.

FIG. 4 is a perspective view of a connector receptacle.

Figure 1:
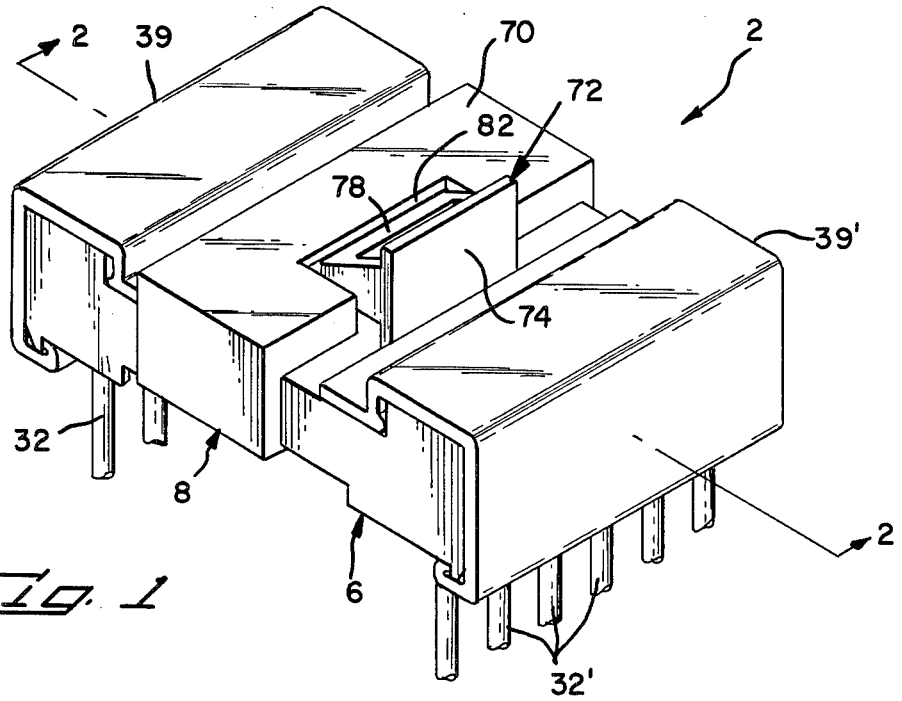
FIG. 1 is a perspective view of a multi-contact connector assembly in accordance with the invention.

A connector assembly 2, in accordance with the invention comprises a plug connector 4 and a receptacle connector 6, the two connector parts being shown in their mated condition in FIG. 1 and serving to connect the wires 32, 32' extending to the connectors to each other. Both of the connector parts are advantageously produced by injection molding of any suitable thermoplastic material such as a nylon composition.

Figure 2:
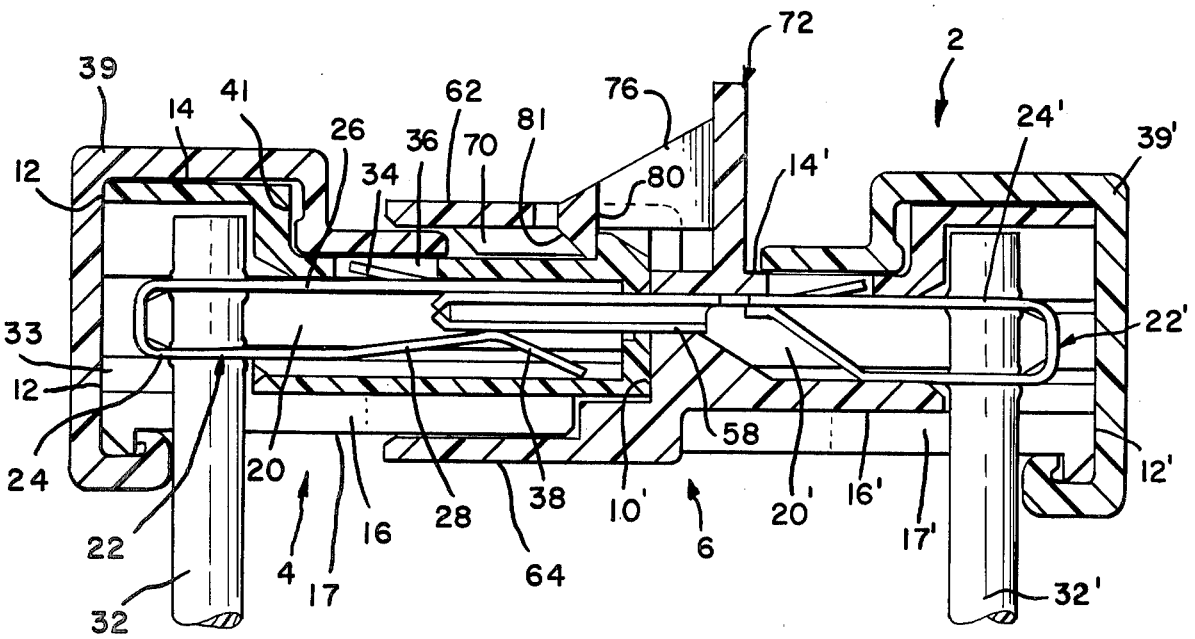
FIG. 2 is a cross-sectional view taken along the lines 2—2 of FIG. 1.

The plug connector 4 comprises a housing 8 having mating face 10, a wire-receiving face 12, sidewalls 14, 16, and endwalls 18 extending between the faces. A. Plurality of terminal-receiving cavities 20 extend through the housing from the wire-receiving face to the mating face and are arranged as a row which extends between the endwalls 18. An electrical contact terminal 22 is mounted in each cavity 20 and comprises a generally U-shaped portion 24 adjacent to the face 12 and arms 28, 26 which extend towards the mating face. A wire-receiving slot is provided in the U-shaped portion 24 and wires 32 are disposed in the slots of these terminals, the arrangement being such that the edges of the slots penetrate, and extend into, the insulation of the wires to establish electrical contact with the conducting cores of the wires. These wires extend laterally through openings 33 in the sidewall 16, as shown in FIG. 2. The arm 26 has a lance 34 struck therefrom which is received in opening 36 in the sidewall 14 for retention purposes and the arm 28 has an inwardly formed end 38 to provide a contact spring for the contact pin portion 58 of the terminal 22' in the receptacle. In the embodiment shown, the face 12 is protected by a separate back cover 39 which extends over the sidewall 14 past the offset portion 41 thereof and over and across the openings 36.

Two spaced-apart camming ramps 40 are provided on the sidewall 14, each camming ramp comprising a first ramp surface 44 which extends from the edge 42 between the sidewall 14 and the face 12 rearwardly towards the offset portion 41 of the housing. This first ramp surface 44 merges with the flat ridge 46 which in turn merges with a second ramp surface 48 which extends towards and merges with the surface of the sidewall 14.

In addition to the camming ramps 40, a pair of latch ears 50 are provided on the surface 14 and are located between the spaced-apart camming ramps. Each latch ear has an inclined ramp surface 52 which is coplanar with the surfaces 44 and which extends to a ridge 54 which is coplanar with the ridges 46. The ears 50 also provide an abrupt shoulder 56 which is directed towards the offset portion 41 of the housing and which cooperates with a latching arm, of the receptacle connector 6 as will be described below. The ridges 46 of ramps 40 and the ridges 54 of the ears 50 are at the same elevations above the surface of sidewall 14 for reasons noted below.

The receptacle connector 6 has a housing portion 8' which is in many respects similar to the housing 8 of the plug 4 and need not be described in detail. Accordingly, the same reference numerals, differentiated by prime marks, are used to identify corresponding structural features of the housings 8 and 8'. Thus, the housing 8' has mating and wire-receiving faces 10', 12', cavities 20', and a back cover 39' as previously described. The terminals 22' differ from the terminals 22 in that they have formed contact pin portions 58 on their ends which project through openings in the mating end 10' of the housing and which are received between the arms 26, 28 of the terminals 22. Ribs 17' are provided on the sidewall 16 as shown, and these ribs extend between adjacent conductors which are connected to the terminals.

A hood 60 extends forwardly from the mating face 10' of the housing 8'. This hood surrounds the mating face and the leading end portion of the plug 4 when the parts 4, 6 are engaged with each other, as shown in FIG. 2. The hood has sidewalls 62, 64 and endwalls 65 which are integral extensions of the sidewalls 14', 16' and endwalls 18' of the housing 8'. The internal surface 66 of the sidewall 64 is provided with spaced-apart grooves 68 which receive the ribs 17 of the plug connector 4. The internal surface of the sidewall 62 of the hood is provided with spaced-apart stabilizing ribs 70 which extend from the leading edge of the sidewall rearwardly towards the housing portion 8'. The distance between these ribs 70 is such that when the parts are mated with each other, the camming ramps 40 and the latch ears 50 will be between the ribs. As shown in FIG. 2, when the parts are mated these ribs bear against the surface of the sidewall 14 of the connector plug 4 and stabilize the two parts relative to each other.

The two connector parts are latched to each other by latching means 72 which comprises an integral support plate 74 extending upwardly from the sidewall 14' and from which forwardly extending arms 76 project. A transverse latch bar or ear 78 extends between the ends of these arms and this bar has a rearwardly facing shoulder surface 80 which is engageable with the shoulders 58 of the locking ears 50. As shown in FIG. 2, the downwardly facing surface 81 of the bar 78 is inclined so that the latch bar will ride over surfaces 52 of the ears 50 when the parts are mated with each other. An opening 82 is provided in the sidewall 62 and the latch bar projects through this opening as shown best in FIG. 2. It will be understood that the integral plate 74 should be dimensioned such that it can be flexed to the extent necessary to permit limited upward movement of the latch bar 80 when the two connector parts are engaged with and disengaged from each other.

It will be apparent from the FIGS. 1–4 that the plug 4 can thus be mated with the receptacle 6 when it is required that the wires 32 be disengageably connected to the wires 32'. Either of the connector parts 4, 6 can be provided with panel mounting means as described in the above identified application Ser. No. 879,575, if required.

Figure 5:
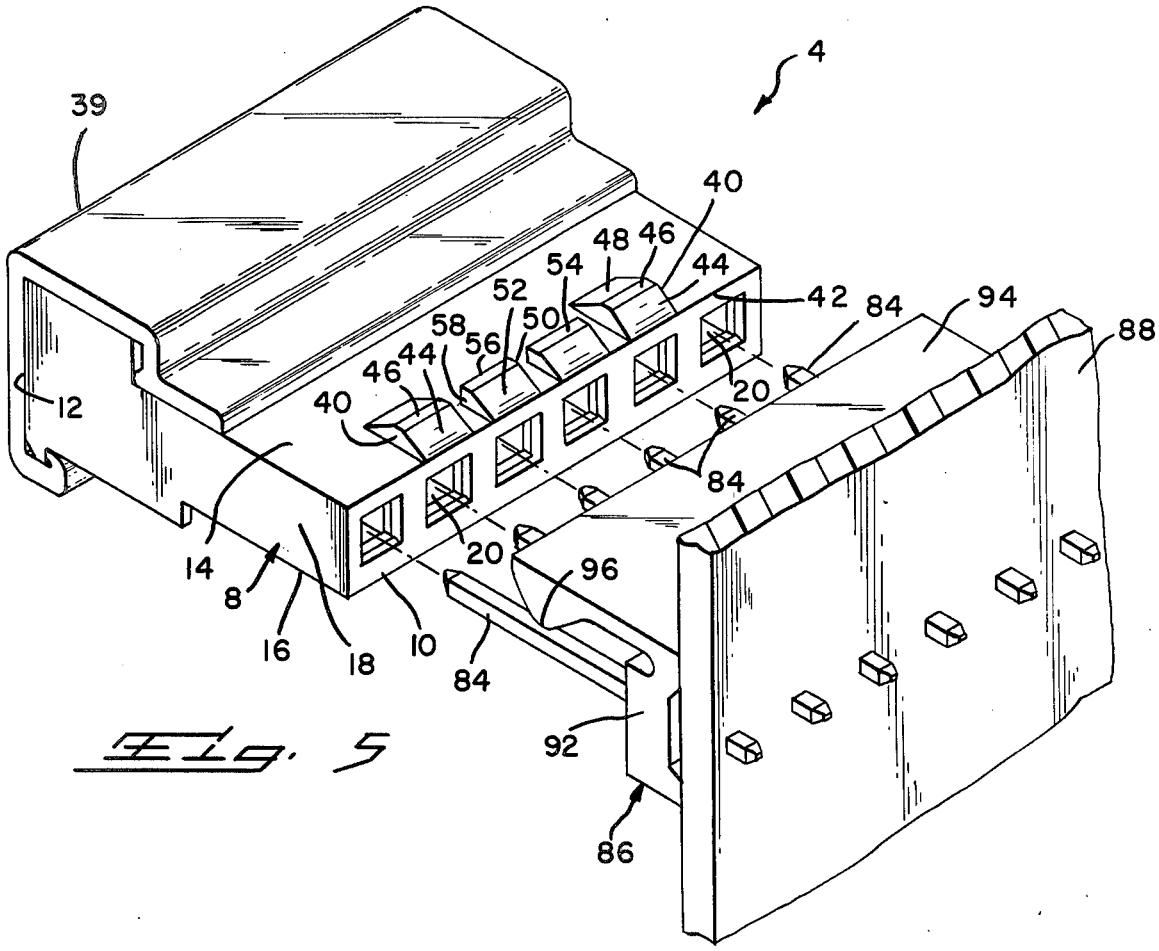
FIG. 5 is a view showing a circuit board having a terminal post header mounted thereon and a plug in accordance with the invention.
Figure 6:
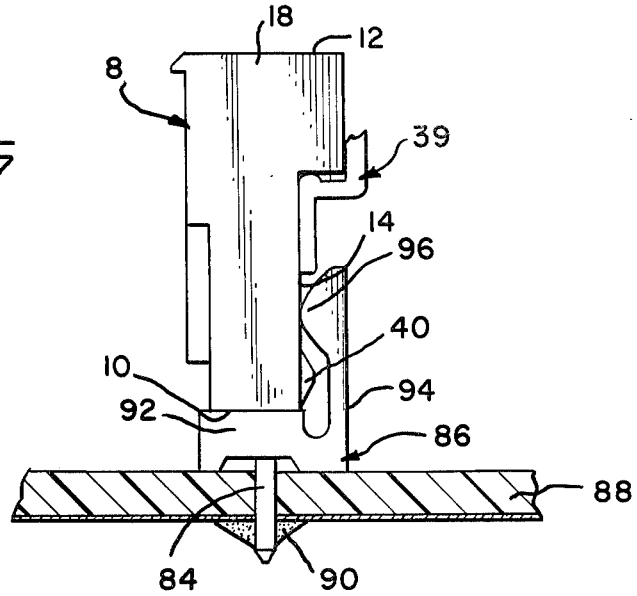
FIG. 6 is a view showing a connector plug in accordance with the invention mated with the post header.

FIGS. 5 and 6 illustrate the use of a connector 4 for connecting the individual wires 32 to terminal posts 84 which extend from a post header 86 mounted on a circuit board 88. Post headers of the type shown at 86 are widely used and provide a convenient method of mounting individual terminal posts 84 in a circuit board since it is merely necessary to position the header on the circuit board with the posts extending through openings thereon. The lower ends of the posts are commonly soldered as shown at 90, to conductors on the underside of the board 88.

The header 86 has a base 92 and a flexible arm 94 extending from one side thereof which arm has an inwardly projecting enlarged section 96 at its upper end. In conventional and current practice, these arms and the projecting portions 96 thereof are adapted positively to engage shoulders on the known types of connectors which are used with such headers.

In the disclosed embodiment, the connector 4 can be mated with the post header 86 by merely aligning the cavities 20 with the upper ends of the posts 84 and moving the connector to the position shown in FIG. 6. During such movement of the connector, the ramp surfaces 44 and the ramp surfaces 52 flex the arm 94 rightwardly as viewed in FIG. 6 and the arm then rides over the ramp surfaces 48 of the camming projections 40. The inwardly directed portion 96 of the arm 94 provides a frictional force on the sidewall 14 which serves to discourage any unintentional removal of the connector from the header and to prevent such slight movement as may take place under the influence of vibration. When the connector 4 is disengaged from the header, it is merely pulled upwardly from the position shown in FIG. 6 and the ramp surfaces 48 serve to flex the latching arm rightwardly so that the projecting portion 96 does not engage the shoulders 58. The fact that the ridges 46 and 54 are coplanar ensures that the projecting portion 96 of arm 94 will not engage the shoulders 56.

It will be apparent from FIG. 6 that while there is no direct engagement of the portion 96 of the arm 94 with the ramps 48, these ramps do discourage unintentional removal of the connector plug 4 since sufficient upward force must be applied to the connector 4 to flex the arm outwardly during removal. An advantage of this arrangement is that the operation in removing the connector 4 from the header 84 can be accomplished with one hand and it is unnecessary, as with many previous post headers, to disengage interlocking shoulders on the arm 94 and connector 4 with one hand and pull the connector away from the header with the other.

I claim:

1. A plug type multi-contact electrical connector which is adapted to be disengageably mated with a complementary receptacle connector and which can also be mated with a post header on a circuit board, said plug connector comprising:

an insulating housing having a mating face and a wire-receiving face, sidewalls and endwalls extending between said mating face and said wire-receiving face, a plurality of terminal-receiving cavities extending through said housing and between said faces, said cavities being in a single row which extends between said endwalls, a pair of spaced-apart latch ears centrally located between said endwalls on one of said sidewalls, each of said latch ears each having a ramp portion which extends obliquely beginning at said mating face away from said one sidewall and towards said wire-receiving face, each of said latch ears further having a latching shoulder spaced from said mating face and directed towards said wire-receiving face, a pair of spaced-apart camming ramp members extending from said one sidewall, said latch ears being between said camming ramp members, each of camming ramp members comprising a first ramp which begins at said mating face and extends obliquely away from said one sidewall and towards said wire-receiving face, said first ramp merging at a ridge with a second ramp which extends obliquely towards, and merges with, said one sidewall and extends towards said wire-receiving face, said ridges of said camming ramp members having an elevation above said one sidewall which is at least equal to the elevation of said shoulders above said one sidewall whereby, said connector can be mated with a receptacle connector having positive latch means which are engageable with said shoulders to latch said receptacle connector to said plug connector, and said plug connector can aso be mated with a pin header having a latch arm extending therefrom, said camming ramp members being engageable with said latch arm to flex said latch arm away from said locking ears when said plug connector is mated with, and unmated from said pin header.

2. An electrical connector assembly comprising a connector plug and a connector receptacle, said plug comprising:

a plug housing of insulating material, said housing having a mating face and a wire-receiving face, sidewalls and endwalls extending between said mating face and said wire-receiving face, a plurality of terminal-receiving cavities extending through said housing and between said faces, said cavities being in a row which extends between said endwalls, spaced-apart latch ear means on one of said sidewalls, said latch ear means having a ramp portion which extends obliquely away from a location adjacent to said mating face away from said one sidewall and towards said wire-receiving face, said latch ear means further having a latching shoulder spaced from said mating face and directed towards said wire-receiving face, camming ramp means extending from said one sidewall, said camming ramp means comprising a first ramp which extends from a location adjacent to said mating face obliquely away from said one sidewall and towards said wire-receiving face, said first ramp merging at a ridge with a second ramp which extends obliquely towards and merges with said one sidewall, said ridge of said camming ramp means having an elevation above said first sidewall which is at least equal to the elevation of said shoulder above said first sidewall; said receptacle comprising:

a receptacle housing having a mating face and a wire-receiving face, sidewalls and endwalls extending between said faces, a plurality of contact-receiving cavities extending through said connector and between said faces, said cavities being arranged in a row which extends between said endwalls, an integral hood extending from said sidewalls and said endwalls beyond said mating face and surrounding said mating face, said hood having sidewalls and endwalls which constitute extensions of said sidewalls and said endwalls of said receptacle housing, said hood being dimensioned to receive said mating face of said plug housing and portions of said sidewalls and endwalls of said plug housing, latching means for latching said receptacle to a said plug comprising a latch arm which is integral with, and extends from, one of said sidewalls of said receptacle said latch arm having portions which extend forwardly past said mating face of said receptacle housing, said latch arm having a latching shoulder thereon which is directed towards said mating face of said receptacle housing, said hood having an opening thereon adjacent to said latch arm, portions of said latch arm extending through said opening whereby, upon mating said receptacle with said plug, the mating face of said receptacle is moved against the mating face of said plug and said latch arm engages said latching shoulder on said plug to secure said plug to said receptacle.

3. An electrical connector assembly as set forth in claim 2, said latch ear means comprising at least two spaced-apart latch ears, said camming ramp means comprising at least two camming ramps, said latch ears being between said camming ramps.

4. A multi-contact receptacle connector which is adapted to be mated with and latched to a complementary plug connector, said receptacle connector comprising:

an insulating housing having a mating face and a wire-receiving face, sidewalls and endwalls extending between said faces, a plurality of contact-receiving cavities extending through said connector and between said faces, said cavities being arranged in a row which extends between said endwalls, an integral hood extending from said sidewalls and said endwalls beyond said mating face and surrounding said mating face, said hood having sidewalls and endwalls which constitute extensions of said sidewalls and said endwalls of said housing, latching means for latching said receptacle connector to a complementary plug connector, said latching means comprising an integral plate-like member extending normally from one of said sidewalls, said plate-like member being adjacent to said mating face and being in a plane extending normally of said endwalls, a pair of parallel spaced-apart latch arms extending from said plate-like member past said mating face, a depending lip extending between, and being integral with, the free ends of said latch arms, said lip having a latching shoulder thereon, said plate-like member being flexible normally of its own plane away from said mating face thereby to raise said latch arms, and said hood having an opening therein, said latch arms and said lip being received in said opening whereby, upon mating said receptacle connector with a complementary plug connector, said plug connector is moved against said mating face of said receptacle connector, and said lip and said latch arms are cammed by latch ear means on said complementary plug connector with accompanying flexure of said plate-like member until said shoulder on said lip engages complementary shoulder means on said plug connector.

* * * * *